US006520404B1

(12) United States Patent
Waldburger et al.

(10) Patent No.: US 6,520,404 B1
(45) Date of Patent: Feb. 18, 2003

(54) CARTON, METHOD OF FORMING SAME, AND CARTON BLANK

(75) Inventors: Peter Waldburger, Mississauga (CA); Andre Odilon Bernatchez, Mississauga (CA); Jamie Alan MacLean, Mississauga (CA); Edwin John Fox, Mississauga (CA); Leon Michael Brzezinski, Mississauga (CA); Gregory Nathaniel Kimmett, Mississauga (CA)

(73) Assignee: Somerville Packaging Systems, a division of Paperboard Industries Corporation, Mississauga (CA)

( * ) Notice: Subject to any disclaimer, the term of this patent is extended or adjusted under 35 U.S.C. 154(b) by 0 days.

(21) Appl. No.: 09/699,965

(22) Filed: Oct. 30, 2000

(51) Int. Cl.[7] ..... B65D 5/08

(52) U.S. Cl. ..... 229/137; 229/215; 229/221; 493/128; 493/162; 493/183

(58) Field of Search ..... 229/137, 138, 229/184, 215, 221; 493/128, 162, 163, 164, 175, 183

(56) References Cited

U.S. PATENT DOCUMENTS

| | | | | | |
|---|---|---|---|---|---|
| 355,862 | A | * | 1/1887 | Clark | 229/137 |
| 356,747 | A | * | 1/1887 | Clark | 229/184 |
| 1,994,923 | A | * | 3/1935 | Ross | 229/137 |
| 2,646,917 | A | | 7/1953 | Smith | |
| 2,819,831 | A | * | 1/1958 | Polarek et al. | 229/221 |
| 3,229,890 | A | * | 1/1966 | Wright | 229/137 |
| 3,348,756 | A | * | 10/1967 | Boysen | 229/184 |
| 3,801,001 | A | | 4/1974 | Taylor | |
| 4,211,357 | A | | 7/1980 | Lisiecki | |
| 4,836,384 | A | * | 6/1989 | Tuns et al. | 229/221 |
| 5,150,833 | A | * | 9/1992 | Hong | 229/215 |
| 5,413,273 | A | * | 5/1995 | Money | 229/138 |
| 6,056,680 | A | | 5/2000 | Spronk-Dik | 493/151 |

FOREIGN PATENT DOCUMENTS

| | | |
|---|---|---|
| CH | 424 613 | 11/1996 |
| FR | 2 356 565 | 1/1978 |
| FR | 2 731 204 | 9/1996 |

OTHER PUBLICATIONS

The Wiley Encyclopedia of Packaging Technology, John Wiley & Sons, pp. 4, 5, 140, 141 (1986).*

"EXPRESSO—Tight without an inner bag."; brochure of AB Akerlund & Rausing, P.O. Box 22, S–22100 Lund, Sweden.

* cited by examiner

*Primary Examiner*—Gary E. Elkins

(74) *Attorney, Agent, or Firm*—Arnold B. Silverman; Brij K. Agarwal; Eckert Seamans Cherin & Mellott, LLC

(57) ABSTRACT

The top of a carton, with opposite main panels and opposite side panels, has an inner and outer major flap hinged to opposite main panels. At each side panel, an ear has a lower portion hinged to the side panel and two upper ear-halves, one hinged to each of the major flaps. To seal the top, adhesive is applied to an outer face of the inner major flap and to the ear-halves extending from either end of one of the major flaps, usually the inner major flap. Then the inner major flap is folded down and the ear-halves extending therefrom are folded down and out. The outer major flap with extending ear-halves is folded on top in overlapping relation so that the adhesive bonds. In one aspect, each ear has a notch between the ear-halves to facilitate overlapping of the ear-halves. With the carton blank coated with an impermeable coating, the resulting carton is air tight.

34 Claims, 8 Drawing Sheets

CARTON, METHOD OF FORMING SAME, AND CARTON BLANK

FIELD OF THE INVENTION

This invention relates to a carton blank, a carton, and a method of forming the carton. The carton design facilitates manufacture of a carton which is substantially air tight.

BACKGROUND

Food must generally be packaged in air tight packaging to avoid infestations. Traditional cereal boxes have four flaps: two end flaps which fold in and are overlain by an interior major flap and an outer major flap. Such a box leaves pin hole openings to its interior at its corners. Thus, to be suitable to contain food, these cereal boxes are provided with an interior air tight bag.

A number of carton designs are known which provide an air tight carton avoiding the need for an air tight bag. One such carton design is used in many milk cartons and is described, in one variation, in U.S. Pat. No. 4,211,357 to Lisiecki issued Jul. 8, 1980. The carton bottom has two major flaps and two end panels which are ears joined between the two major flaps. A heat seal adhesive is applied to the ears and one major flap then the ears are folded in and the major flaps folded down while the carton sits on a mandrel. Pressure and heat is then applied to seal the bottom. The carton top comprises two ears joined between two major panels. The two ears are folded in and a heat seal adhesive applied to the inside top margin of one of the major panels. The top margins of the major panels are then pressed together while heated to seal same. This results in a gable top.

While a gable top carton allows the carton to be sealed after filling, there is considerable empty head space in the carton. The gable top also precludes stacking of the cartons.

Another carton design, often used for long shelf life storage of juice or other liquids, comprises a sleeve with, at its top and bottom, two major panels which each terminate in an ear-half at either end. For each pair of major panels, a heat seal surface is provided on the inside face of the margin of the major panels. After applying a heat sealable material, the pair of major panels is pressed together with heat to form a fin seal. This also joins opposed ear-halves; the ears are then folded down and spot glued to the carton.

The fin sealed carton makes better use of the interior volume of the carton, however, re-sealing of such a carton after opening presents difficulties. In some such cartons, it is contemplated that the carton is opened by cutting through the fin seal: in such case, re-sealing is not possible. In other such cartons, a re-closeable flap (e.g., a plastic fitment) may be added to the top of the carton. However, such a flap provides only a relatively small access area to the inside of the carton. Thus, while such a flap may be adequate for a carton containing a liquid, in many instances it may not be adequate for a carton containing dry goods.

Both gable top and fin seal cartons require application of pressure from opposite sides to seal the carton top, as well as the presence of a heat sealable material. This increases the difficulty of manufacturing such cartons.

U.S. Pat. No. 6,056,680 issued May 2, 2000 to Spronk-Dik describes an airtight carton which requires the adhesion of a separate material strip to the carton blank.

Accordingly, a need remains for a carton which is capable of providing an air tight seal, may provide efficient use of the interior volume of the carton, may be stackable, and may be readily manufactured.

SUMMARY OF THE INVENTION

The top of a carton, with opposite main panels and opposite side panels, has an inner and outer major flap hinged to opposite main panels. At each side panel, an ear has a lower portion hinged to the side panel and two upper ear-halves, one hinged to each of the major flaps. To seal the top, adhesive is applied to an outer face of the inner major flap and to the ear-halves extending from either end of one of the major flaps, usually the inner major flap. Then the inner major flap is folded down and the ear-halves extending therefrom are folded down and out. The outer major flap with extending ear-halves is folded on top in overlapping relation so that the adhesive bonds. In one aspect, each ear has a notch between the ear-halves to facilitate overlapping of the ear-halves.

Accordingly, the present invention provides a carton comprising: a first main panel; a second main panel; a pair of opposed side panels hinged between said main panels; an inner major flap extending along said first main panel and hinged thereto; an outer major flap extending along said second main panel and hinged thereto, said outer major flap having a width so as to provide an overlapping portion along its length with said inner major flap; a pair of opposed outwardly projecting ears, each ear having a lower ear portion extending from a top of one of said side panels, an upper ear-half extending from an end of said inner major flap and an upper ear-half extending from an end of said outer major flap, one upper ear-half of a given ear having a width so as to provide an overlapping portion along its length with another upper ear-half of said given ear; an adhesive bond between an inside face of said outer major flap and an outside face of said inner major flap along said overlapping portion of said flaps and between an inside face of said one, overlapping, upper ear-half and an outside face of said another upper ear-half of each ear along said overlapping portion of said ear halves.

According to another aspect of the present invention, there is provided a carton blank, comprising: a first main panel; a second main panel; a medial side panel hinged to said first main panel at a hinge line and to said second main panel at a hinge line; a first major flap hinged to said first main panel at a hinge line; a second major flap hinged to said second main panel at a hinge line; a medial ear panel hinged to said medial side panel at a hinge line, hinged to said first major flap at a hinge line and hinged to said second major flap at a hinge line, said medial ear panel having a free edge opposite said hinge line between said medial side panel and said medial ear panel, said free edge having a notch.

According to a further aspect of the invention, there is provided a method of forming a carton, comprising:

(a) folding and gluing closed a bottom of said carton;

(b) at a top of said carton having a first major flap hinged to a first main panel of said carton, a second major flap hinged to a second main panel of said carton, two ears each having a lower portion hinged to one of two side panels, a first upper ear-half hinged to said first major flap, and a second upper ear-half hinged to said second major flap, folding down said first major flap and folding down and out said first upper ear-half of each of said ears;

(c) applying adhesive to an outside face of said first major flap and to an outside face of said first upper ear-half of each said ear either before or after (b);

(d) folding down said second major flap and folding down and out said second upper ear-half of each said ear so that said second major flap overlaps said first major flap and said second upper ear-half of each said ear overlaps said first upper ear-half of each said ear and said adhesive bonds said second major flap to said first major flap and said second upper ear-half of each said ear to said first upper ear-half of each said ear.

Other aspects of the invention will become apparent after a review of the following description and drawings.

BRIEF DESCRIPTION OF THE DRAWINGS

In the figures which illustrate an embodiment of the invention.

DETAILED DESCRIPTION OF THE PREFERRED EMBODIMENTS

Figure 1:
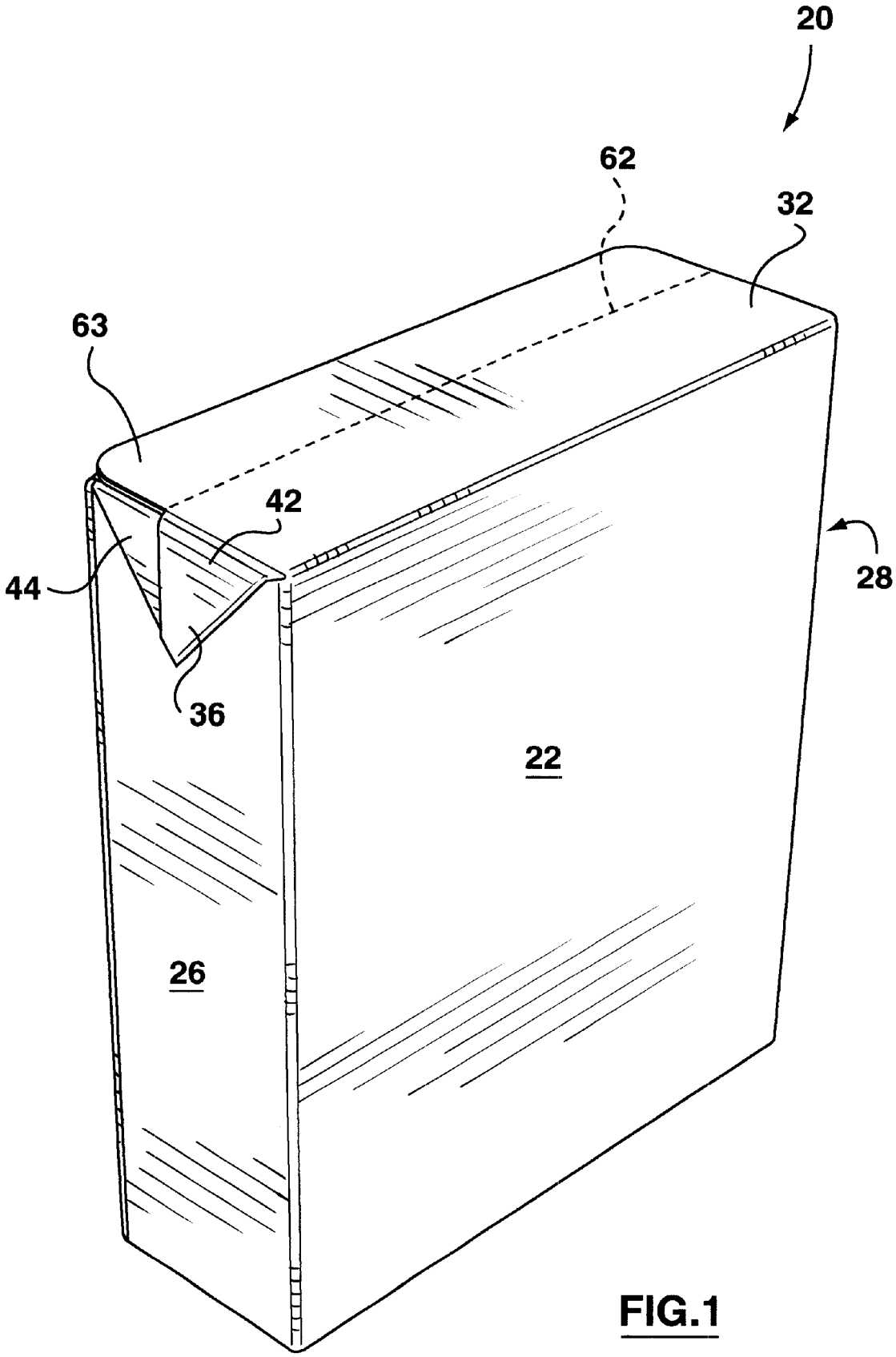
FIG. 1 is a perspective view of a carton.
Figure 7:
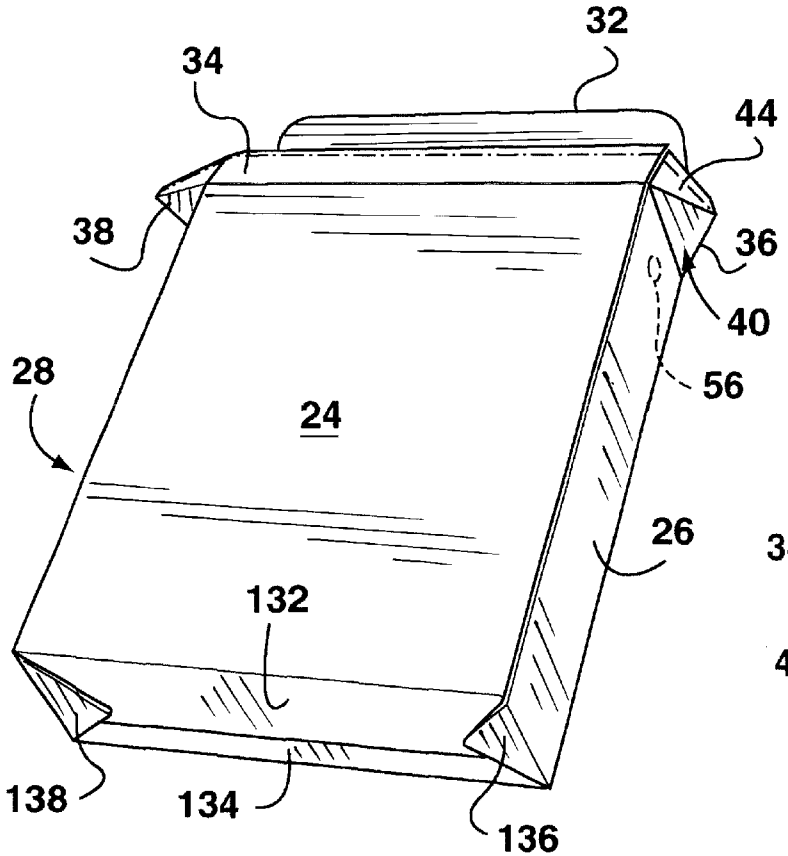

Turning to FIGS. 1 and 7, a carton 20 has two main panels 22 and 24 with a pair of side panels 26 and 28 hinged therebetween. At the top of the carton, an inner major flap 34 is hinged to main panel 24 and an outer major flap 32 is hinged to panel 22. An ear 36, 38 projects outwardly from each end of the major flaps 32, 34 and is glued down to a side panel 26, 28. Each ear has a lower ear portion 40 hinged to the top of a side panel and two upper ear-halves 42, 44, one upper ear-half hinged to each of the major flaps 32, 34.

The outer major flap 32 overlaps the inner major flap 34 and the upper ear-halves 42 extending from the outer major flap 32 overlap the respective upper ear-halves 44 extending from the inner major flap 34. There is an adhesive bond along this overlapping portion between an inside face of the outer major flap 32 and its upper ear-halves 42 on the one hand and the outside face of the inner major flap 34 and its upper ear-halves 44 on the other. Each ear 36, 38 is bonded to its respective side panel 26, 28.

Figure 6:
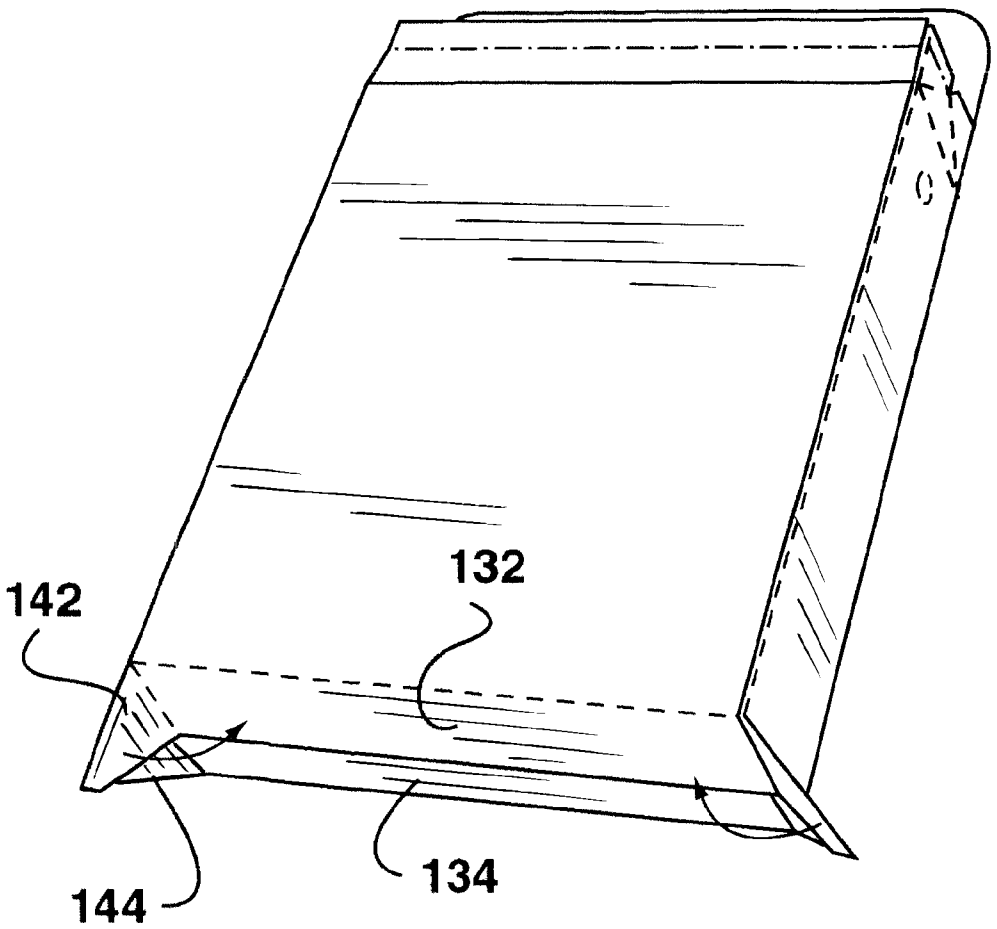

With reference to FIGS. 6 and 7, it is noted that the bottom of the carton is similarly configured with an inner major flap 134 and respective upper ear-halves 144 overlapped by, and bonded to, an outer major flap 132 and respective upper ear-halves 142. However, at the carton bottom, the ears 136, 138 are shown bonded to the outer major panel 132. Alternatively, ears 136, 138 could also be bonded to their side panels 26, 28.

Figure 2:
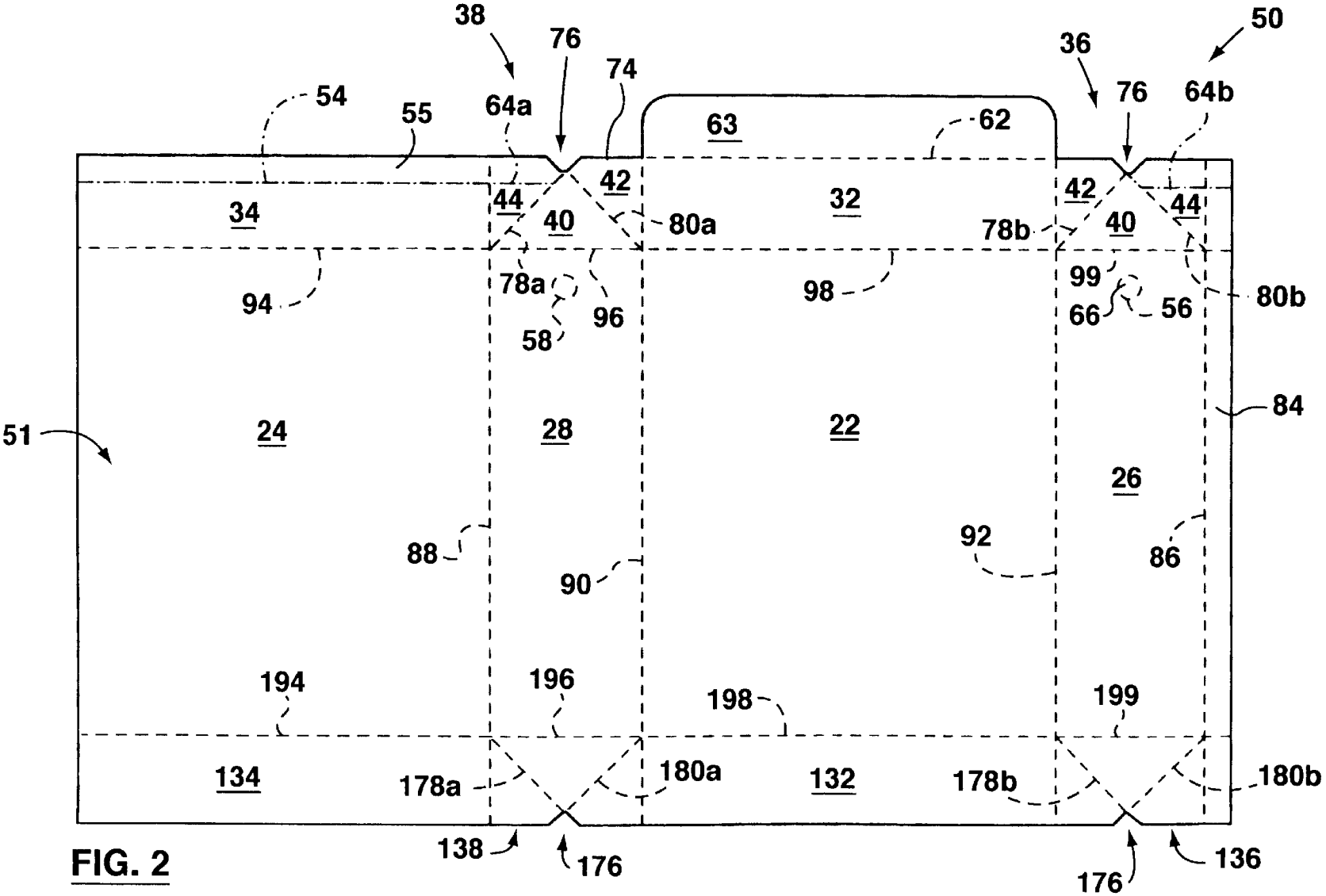
FIG. 2 is a perspective view of a carton blank from which the carton of FIG. 1 may be manufactured.

Returning to FIGS. 1 and 7, and also referencing FIG. 2, which shows a carton blank 50 from which carton 20 is manufactured, a weakened line 54 extends along the inner major flap 34 and weakened lines 64*a*, 64*b* extend along each of upper ear-halves 44. The weakened lines 54, 64*a*, 64*b* are aligned so as to form one continuous weakened line in the completed carton. These weakened lines may be cut scores, lines of perforation, or the like. These weakened lines define a marginal portion 55 along which the adhesive bond extends.

Each side panel 26, 28 has a weakened line 56, 58 formed as a closed (circular) shape 66. This weakened line extends from the outside face of the carton 20 to a depth which is less than the thickness of each side panel. (This depth may be 50% of the thickness of the side panels.) The adhesive bond between the ears 36, 38 and their respective side panels 26, 28 extends within this closed shape 66.

The outer major flap 32 has a medial fold line 62 which overlies the inner major flap 34 weakened line 54. The medial fold line 62 defines a flap end portion 63 of outer major flap 34.

With particular reference to FIG. 2, in the carton blank 50, each ear 36, 38 has a free edge 74 with a notch 76; this notch facilitates overlapping of the upper ear-halves. A fold line 78*a* extends in ear 38 from a top corner of main panel 24 to notch 76. A second fold line 80*a* extends in ear 38 from a top corner of main panel 22 to the notch 76. Similar fold lines 78*b* and 80*b* extend in ear 36, however, fold line 80b extends from a top corner of margin strip 84 defined by hinge line 86. It will also be noted that ears 136 and 138 at the bottom of the carton blank have similar notches 176 and fold lines 178*a*, 178*b*, 180*a*, 180*b*.

Carton blank 50 also shows hinge line 88 between main panel 24 and side panel 28; hinge line 90 between main panel 22 and side panel 28; and hinge line 92 between main panel 22 and side panel 26. Additionally is shown: a hinge line 94 between main panel 24 and inner major flap 34; hinge line 96 between side panel 28 and ear 38; hinge line 98 between main panel 22 and outer major flap 32; hinge line 99 between side panel 26 and ear 36; and similar hinge lines 194, 196, 198, and 199 at the bottom of the blank.

Note that a fold line may be structurally indistinguishable from a hinge line; the two terms were herein merely to indicate a different function.

To adapt the carton blank 50 for use with foods, an air impermeable coating 51 should be applied to the interior face of the blank.

Figure 3:
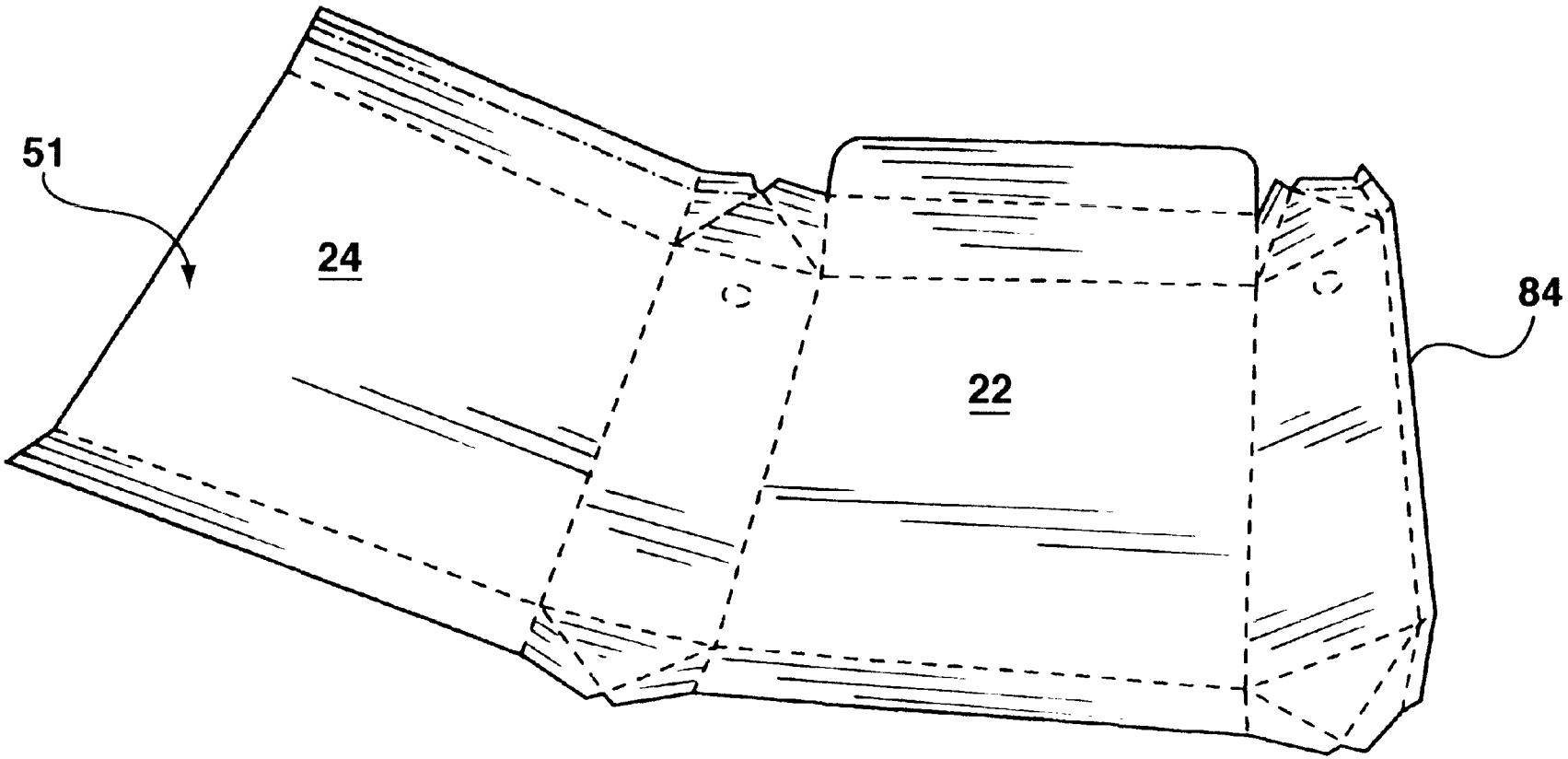
FIGS. 3 to 8 are perspective views illustrating the manufacture of the carton from the blank of FIG. 2, FIGS. 9 to 13 are perspective views illustrating opening and re-closing of the carton of FIG. 1.
Figure 5:
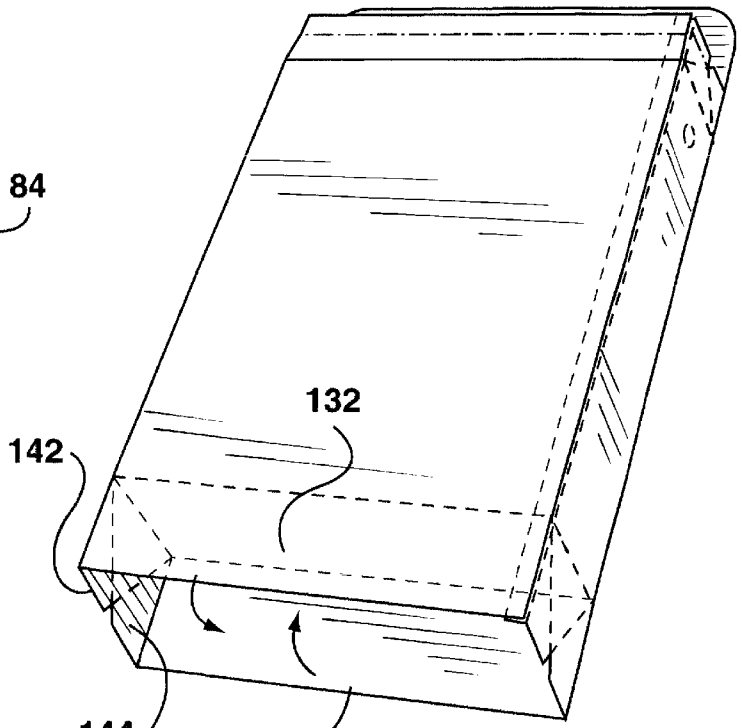
Figure 4:
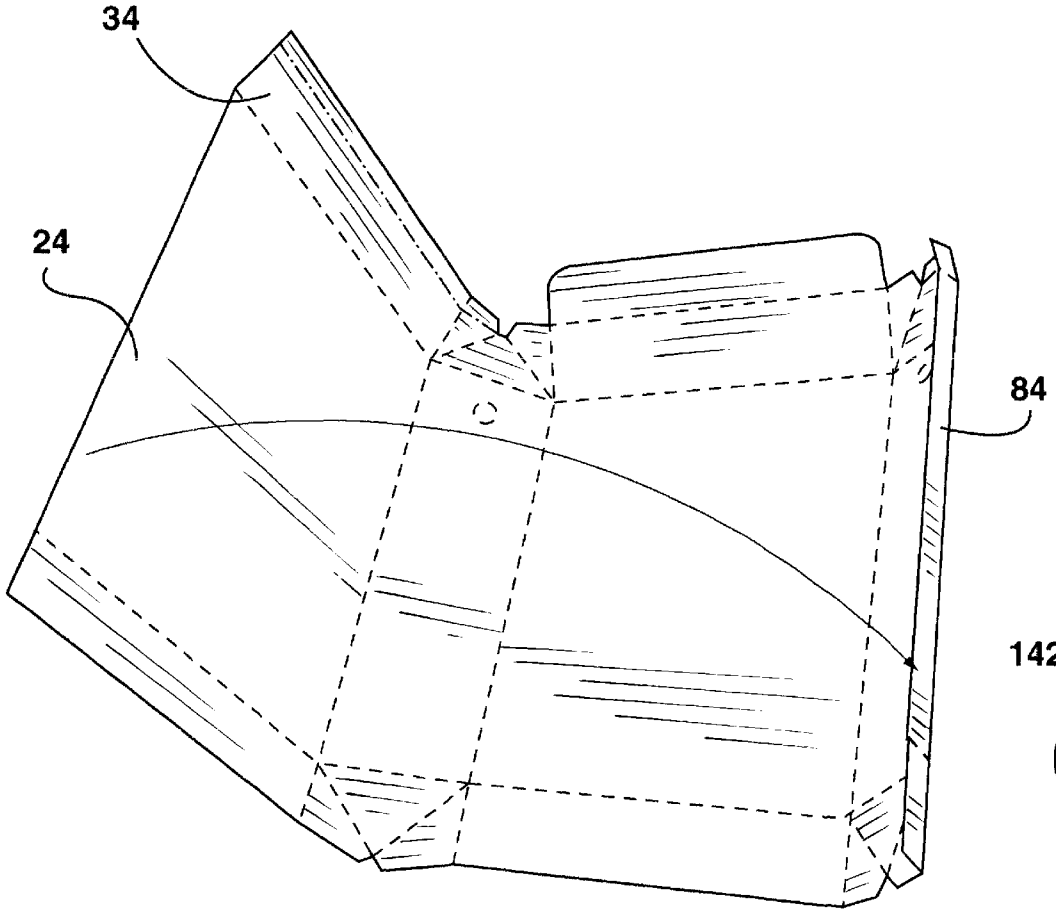

To manufacture a carton 20 of FIG. 1 from a carton blank 50 of FIG. 2, adhesive is to applied one or both of the outside face of margin strip 84 and the inside face of a margin of main panel 24 and inner major flap 34. The carton is formed into a sleeve as illustrated in the sequence of FIGS. 3 to 5 with the margin strip 84 bonded to the margin of main panel 24 and inner major flap 34 by the applied adhesive. Next, the bottom inner major flap 134 is folded down and its attached ear-halves 144 are folded down and out. Adhesive is applied to either or both of the margin of the outside face of the inner major flap 134 and its ear-halves 144 or to the inside face of the outer major flap 132 and its ear-halves 142. The outer major flap and its ear-halves 142 are then folded over, and bonded to, the inner major flap 134 with its ear-halves 144, as seen in FIG. 6. The notches in the ear-halves permit one ear-half to be folded over the other without interference.

With the ear-halves 144 folded down and out, inner major flap 134 is supported at either of its ends by the bottom edge of side panels 26, 28. This sufficiently supports the inner major flap so that the outer major flap may be pressed thereagainst to bond the two in the absence of a mandrel behind the inner major flap. Thus, a mandrel is optional. Also, in consequence of the self-supporting inner flap, a hot melt adhesive may be employed as the applied adhesive.

Next adhesive is applied to the outside face of outer major flap 132 and the ears 136, 138 are folded around and bonded to the outer major flap 132, as seen in FIG. 6. This completes the bottom of the carton.

Figure 9:
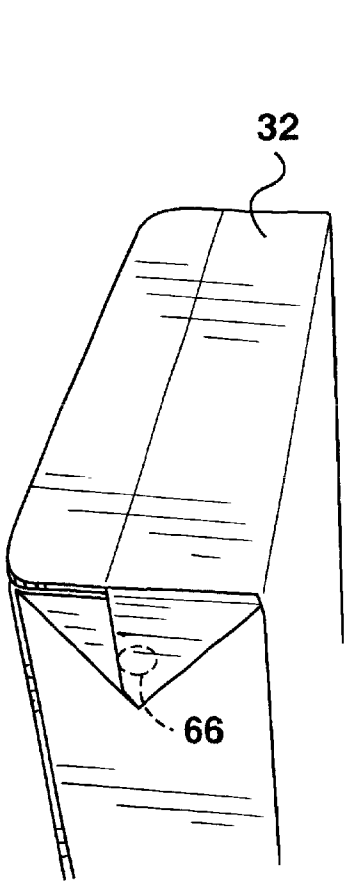
Figure 8:
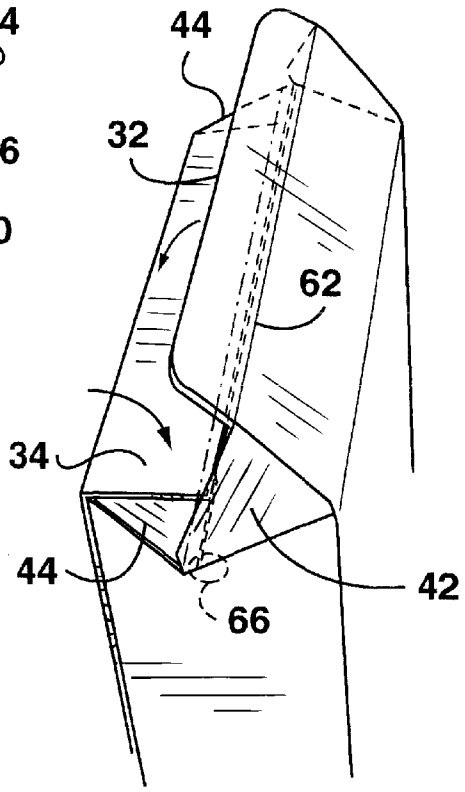

The carton with its completed bottom may then be filled. After filling, the top inner major flap 34 is folded down and its attached ear-halves 44 are folded down and out. This is shown, progressively, in FIGS. 7 and 8. As seen in FIG. 8, this results in the top edge of side panels 26, 28 supporting the ends of the inner major flap 34. Adhesive (which may be hot melt) is applied to either or both of the margin of the outside face of the inner major flap 34 and its ear-halves 44 or to the inside face of the outer major flap 32 inwardly from fold line 62 and to the margins of its ear-halves 42. The outer major flap and its ear-halves 142 are then folded over, and bonded to, the inner major flap 134 with its ear-halves 144, as seen in FIG. 9. Lastly, a spot of adhesive may be applied in each closed shape 66 of side panels 26, 28 and each (now bonded) ear 36, 38 may be folded down and bonded to its respective side panel, also as seen in FIG. 9.

It will be apparent that with a line of adhesive forming a bond from ear-toear at both the top and bottom of the carton 20, there are no pin hole openings to the interior of the carton. Thus, at least where the carton has an air impermeable coating, the carton is air tight. Consequently, carton 20 may be used as a bagless cereal box.

Figure 10:
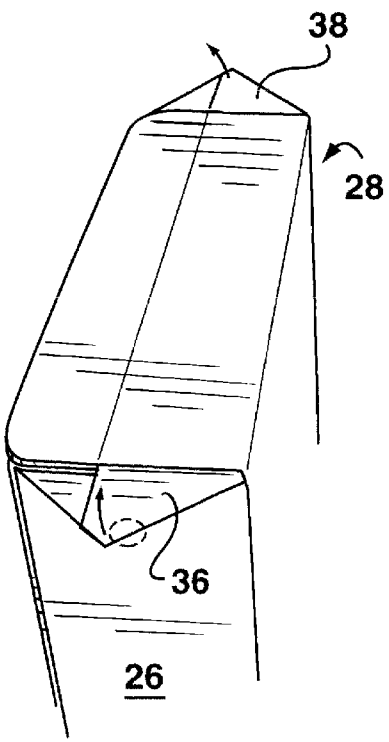

To open carton 20, ears 36, 38 are grasped and pulled away from side panels 26, 28, as seen in FIG. 10. The weakened lines 56, 58 in the side panels which extend to a depth which is less than the thickness of the side panels facilitate this. More particularly, it is not necessary for the adhesive bond between the ears and side panels to be broken as carton material within closed shapes 66 simply pulls away with the ears. Because the weakened lines 56, 58 do not extend to the depth of the side panels, the carton remains impermeable to air even after the ears are pulled away.

Figure 11:
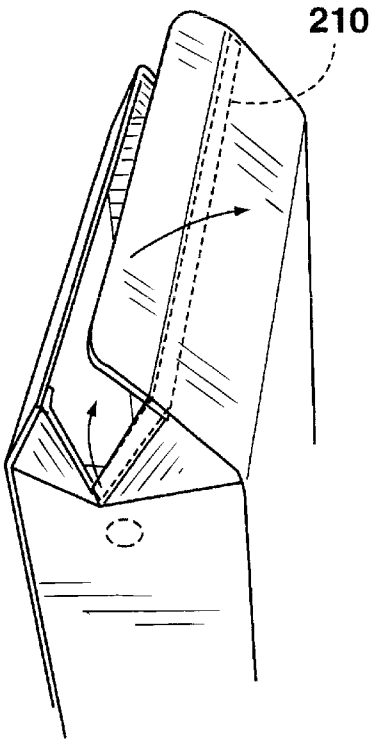

Next, the outside margin of the outer major flap 32 may be grasped and pulled back, as shown in FIG. 11. This causes the weakened lines 54, 64a, 64b to give way resulting in a tear strip 210 (which previously was the marginal portion 55 of the inner major flap and its ear-halves 44) pulling away with the outer major flap 32. Thus, again, it is not necessary to break the adhesive bond between the outer and inner major flaps, nor between their respective ear-halves. After the outer major flap has been pulled back, the interior of the carton may be accessed.

Figure 13:
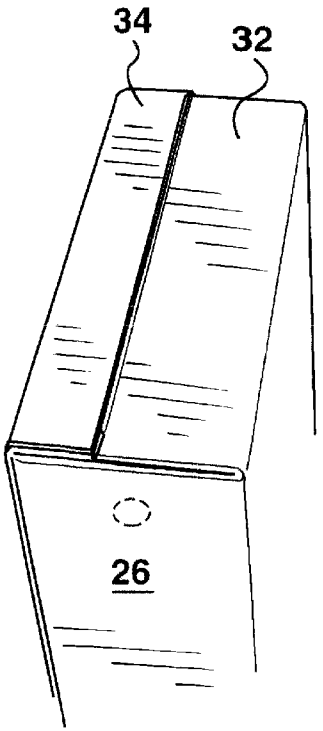
Figure 12:
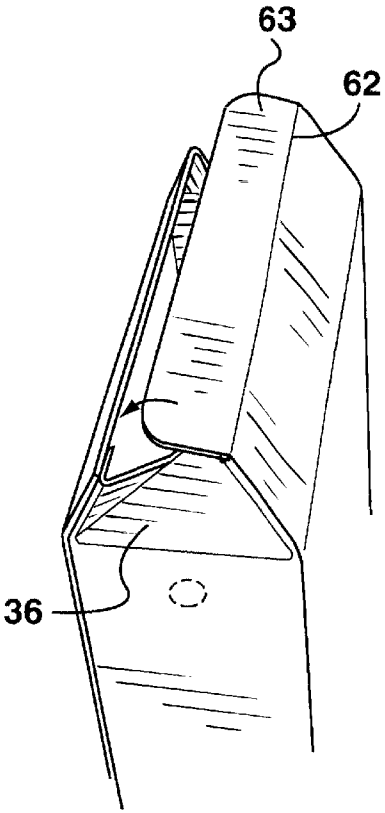
Figure 14:
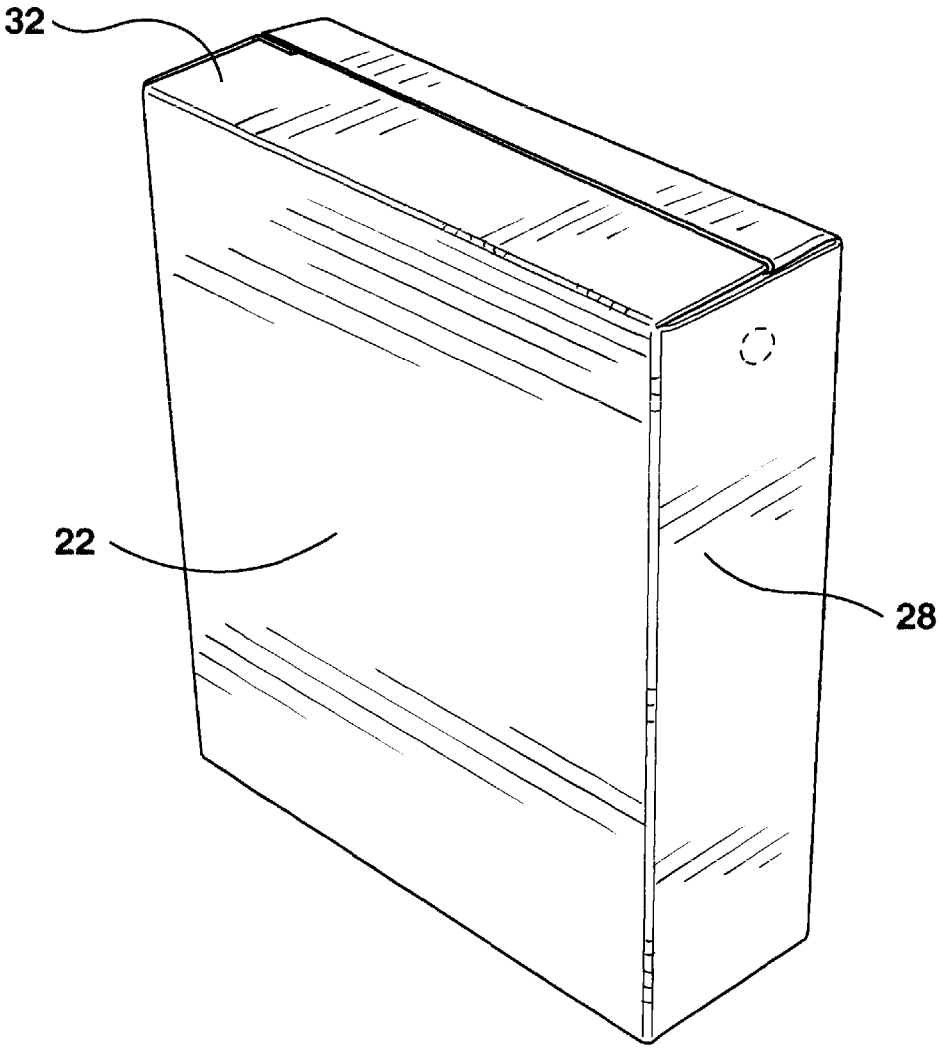
FIG. 14 is a perspective view of a re-closed carton.

To re-close the carton, the ears 36, 38 may be folded inwardly, as seen in FIG. 12. Next the inner major flap may be folded downwardly over top of the lower ear portions 40 of each ear. Then the outer major flap 34 may be bent at its fold line 62. Flap end portion 63 of outer major flap 32 is then inserted between inner major flap 34 and the upper ear-halves 44 which extend from the inner major flap, as seen in FIG. 12. Once the carton is fully re-closed, as seen in FIGS. 13 and 14, the outer major flap end portion 63 underlies the inner major flap 34.

Optionally, the inner and outer major flaps 132, 134 may be embossed so that the ears 136, 138 are more flush with the bottom of carton 20. Alternatively, the bottom ears 136, 138 may be folded around and glued to side panels 26, 28, rather than being folded around and glued to outer major flap 132.

Other modifications will be apparent to those skilled in the art and, therefore, the invention is defined in the claims.

What is claimed is:

1. A carton comprising:

a first main panel;

a second main panel;

a pair of opposed side panels hinged between said main panels;

an inner major flap extending along said first main panel and hinged thereto;

an outer major flap extending along said second main panel and hinged thereto, said outer major flap having a width so as to provide an overlapping portion along its length with said inner major flap;

a pair of opposed outwardly projecting ears, each ear having a lower ear portion extending from a top of one of said side panels, an upper ear-half extending from an end of said inner major flap and an upper ear-half extending from an end of said outer major flap, for each ear, one upper ear-half having a width so as to provide an overlapping portion along its length with another upper ear-half;

an adhesive bond between an inside face of said outer major flap and an outside face of said inner major flap along said overlapping portion of said flaps and between an inside face of said one, overlapping, upper ear-half and an outside face of said another upper ear-half of each ear along said overlapping portion of said ear halves.

2. The carton of claim 1 further comprising a weakened line along one of said inner major flap and said outer major flap so as to provide a major flap marginal portion, said adhesive bond extending along said major flap marginal portion.

3. The carton of claim 2 wherein said major flap weakened line extends along said inner major flap.

4. The carton of claim 2 further comprising, for each ear, a weakened line along one of said one upper ear half and said another upper ear-half so as to provide an upper ear half marginal portion, said adhesive bond extending along said upper ear half marginal portion.

5. The carton of claim 4 wherein for each ear, said upper ear half extending from said inner major flap is overlapped by said upper ear half extending from said outer major flap.

6. The carton of claim 5 wherein for each ear said upper ear half weakened line extends along said upper ear half extending from said inner major flap.

7. The carton of claim 6 wherein said major flap weakened line extends along said inner major flap and wherein each said upper ear half weakened line is aligned with said inner major flap weakened line to form a continuous weakened line extending in and from one of said ears through said inner flap, into another of said ears.

8. The carton of claim 1 further comprising an adhesive bond between said lower ear portion of each ear and said one of said side panels from which said lower ear portion extends.

9. The carton of claim 8 further comprising, for each ear, a side panel weakened line in said one of said side panels, said side panel weakened line defining a closed shape, said side panel weakened line extending from an outside face of said one of said side panels to a depth less than a thickness of said one of said side panels, said adhesive bond between said lower ear portion of said each ear and said one of said side panels extending within said closed shape of said side panel weakened line.

10. The carton of claim 1 further comprising an adhesive bond between each ear and one of said one of said side panels from which said ear extends and said outer major flap.

11. The carton of claim 3 further comprising a fold line extending along said outer major panel, said fold line overlying said inner major panel weakened line.

12. The carton of claim 1 wherein, for each ear, said another upper ear half has a free edge overlapped by said one upper ear half, said another upper ear half having a first extent from an end of said one major flap of said outer major flap and said inner major flap from which said another upper ear half extends at said free edge and a second, greater, extent from said end of said one major flap away from said free edge.

13. The carton of claim 1 wherein, for each ear, said lower ear portion is hinged to each upper ear-half.

14. The carton of claim 1 further comprising a notch between said one upper-ear half and said another upper-ear half of each said ear.

15. The carton of claim 1 further comprising an air impermeable coating on its interior surface.

16. A carton blank, comprising:

a first main panel;

a second main panel;

a medial side panel hinged to said first main panel at a hinge line and to said second main panel at a hinge line;

a first major flap hinged to said first main panel at a hinge line;

a second major flap hinged to said second main panel at a hinge line;

a medial ear panel hinged to said medial side panel at a hinge line, hinged to said first major flap at a hinge line and hinged to said second major flap at a hinge line, said medial ear panel having a free edge opposite said hinge line between said medial side panel and said medial ear panel, said medial ear panel having a first fold line extending from a top corner of said first main panel to said free edge and a second fold line extending from a top corner of said second main panel to said free edge, said medial ear panel having a weakened line extending between said first fold line and said hinge line between said medial ear panel and said first major flap a fold line extending along said second major flap, said fold line being parallel to, but not in alignment with, said weakened line in said medial ear panel.

17. The carton blank of claim 16 further comprising a weakened line extending along said first major flap to said hinge line between said medial ear panel and said first major flap.

18. The carton blank of claim 17 wherein said weakened line in said first major flap is aligned with, and meets, said weakened line in said medial ear panel so as to form a continuous weakened line which extends along said first major flap and into said medial ear panel.

19. The carton blank of claim 18 further comprising a notch in said free edge medially positioned between said first major flap and said second major flap.

20. The carton blank of claim 16 further comprising a medial side panel weakened line defining a closed shape in said medial side panel, said medial side panel weakened line extending from an outside face of said medial side panel to a depth less than a thickness of said medial side panel.

21. The carton blank of claim 16 further comprising:

an outside side panel hinged to said second main panel at a hinge line;

an outside ear panel hinged to said outside side panel at a hinge line and hinged to said second major flap at a hinge line, said outside ear panel having a free edge opposite said hinge line between said medial side panel and said medial ear panel.

22. The carton blank of claim 16 further comprising an air impermeable coating on its interior face.

23. The carton blank of claim 16 wherein said first fold line, said second fold line, and said hinge line between said medial ear panel and said side panel form a generally triangular shape.

24. The carton blank of claim 21 wherein outside ear panel has a first fold line extending from a top corner of said second main panel to said outside ear panel free edge and a second fold line oriented such that said first outside ear panel fold line, said second outside ear panel fold line, and said hinge line between said outside ear panel and said outside side panel form a generally triangular shape, said outside ear panel having a weakened line extending from said second outside ear panel fold line outside of said outside ear panel generally triangular shape.

25. The carton blank of claim 24 wherein said weakened line in said first major flap is aligned with said weakened line in said outside ear panel.

26. The carton blank of claim 16 wherein said second major flap fold line meets said medial ear panel free edge.

27. A method of forming a carton, comprising:

(a) folding and gluing closed a bottom of said carton;

(b at a top of said carton having a first major flap hinged to a first main panel of said carton, a second major flap hinged to a second main panel of said carton, two ears each having a lower portion hinged to one of two side panels, a first upper ear-half hinged to said first major flap, and a second upper ear-half hinged to said second major flap, folding down said first major flap and folding down and out said first upper ear-half of each of said ears;

(c) applying adhesive to an outside face of said first major flap and to an outside face of said first upper ear-half of each said ear either before or after (b);

(d) folding down said second major flap and folding down and out said second upper ear-half of each said ear so that said second major flap overlaps said first major flap and said second upper ear-half of each said ear overlaps said first upper ear-half of each said ear and said adhesive bonds an inside face of said second major flap to said outside face of said first major flap and an inside face of said second upper ear-half of each said ear to said outside face of said first upper ear-half of each said ear.

28. The method of claim 27 further comprising:

applying adhesive to each of said side panels below said ears;

folding each said ear downwardly so that each ear is bonded to one of said side panels.

29. The method of claim 28 wherein each said side panel has a side panel weakened line defining a closed shape and wherein said applying adhesive to each of said side panels comprises applying adhesive within said closed shape formed by said side panel weakened line.

30. The method of claim 28 wherein said applying adhesive to an outside face of said first major flap and to an outside face of said first upper portion of each said ear comprises applying hot melt adhesive.

31. The method of claim 27 wherein said applying adhesive comprises applying a hot melt adhesive.

32. The method of claim 27 further comprising applying an air impermeable coating to an interior surface of said carton.

33. A carton blank, comprising:

a first main panel;

a second main panel;

a medial side panel hinged to said first main panel at a hinge line and said second main panel at a hinge line;

a first major flap hinged to said first main panel at a hinge line;

a second major flap hinged to said second main panel at a hinge line;

a medial ear panel hinged to said medial side panel at a hinge line, hinged to said first major flap at a hinge line and hinged to said second major flap at a hinge line, said medial ear panel having a free edge opposite said hinge line between said medial side panel and said medial ear panel; and a weakened line defining a closed shape in said carton blank, said weakened line extending from an outside face of said carton blank to a depth less than a thickness of said carton blank.

34. The carton blank of claim 33 wherein said weakened line defining said closed shape is in said medial side panel.

* * * * *